US009682555B2

(12) United States Patent
Pannekoek et al.

(10) Patent No.: US 9,682,555 B2
(45) Date of Patent: Jun. 20, 2017

(54) INKJET PRINT HEAD WITH IMPROVED LIFETIME AND EFFICIENCY

(71) Applicant: Océ-Technologies B.V., Venlo (NL)

(72) Inventors: Reinder Pannekoek, Venlo (NL); Hans Reinten, Venlo (NL); René Van Der Meer, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/205,450

(22) Filed: Jul. 8, 2016

(65) Prior Publication Data

US 2017/0021624 A1 Jan. 26, 2017

(30) Foreign Application Priority Data

Jul. 24, 2015 (EP) ..... 15178222

(51) Int. Cl.
*B41J 2/14* (2006.01)

(52) U.S. Cl.
CPC ..... *B41J 2/14209* (2013.01); *B41J 2/14233* (2013.01); *B41J 2002/1437* (2013.01); *B41J 2002/14241* (2013.01); *B41J 2002/14306* (2013.01); *B41J 2002/14491* (2013.01); *B41J 2202/03* (2013.01); *B41J 2202/11* (2013.01)

(58) Field of Classification Search
CPC ..... B41J 2/14209; B41J 2/14233; B41J 2002/14306; B41J 2002/14241
See application file for complete search history.

(56) References Cited

U.S. PATENT DOCUMENTS 6,338,551 B1 * 1/2002 Sugiura ..... B41J 2/14233 347/70
2010/0097431 A1 * 4/2010 Takakuwa ..... B41J 2/14233 347/68
2010/0149284 A1 6/2010 Yazaki
2012/0229573 A1 9/2012 Mizukami et al.

FOREIGN PATENT DOCUMENTS

EP 0 800 920 A2 10/1997
EP 0 919 383 A2 6/1999

* cited by examiner

*Primary Examiner* — Geoffrey Mruk
(74) *Attorney, Agent, or Firm* — Birch, Stewart, Kolasch & Birch, LLP

(57) ABSTRACT

In a print head having a bimorph thin-film piezo actuator, the piezo-electric actuator is arranged on a membrane at a first side of the piezo-electric actuator and a passive layer is arranged on the piezo-electric actuator at a second side of the piezo-electric actuator, wherein the second side is opposite to the first side. The membrane is more compliant, at least in a lateral direction, for contraction than the passive layer. Thus, a bending direction of the actuator is affected. As a consequence, there is no need for a bias voltage on the actuator during a standby state of the print head. Omitting the bias voltage during standby results in an increased lifetime and stability of the actuator assembly.

9 Claims, 4 Drawing Sheets

INKJET PRINT HEAD WITH IMPROVED LIFETIME AND EFFICIENCY

FIELD OF THE INVENTION

The present invention generally pertains to a piezo-electric actuated inkjet print head and in particular an inkjet print head provided with a bimorph piezo-electric actuator.

BACKGROUND ART

An inkjet print head with piezo-electric actuators is well known in the art. Such a known print head comprises a number of pressure chambers. Each pressure chamber is in fluid communication with a respective nozzle orifice and each pressure chamber is provided with a flexible wall. The flexible wall is operatively coupled to a piezo-electric actuator. Upon actuation, the piezo-electric actuator deforms, thereby deforming the flexible wall resulting in a volume change of the pressure chamber. In operation, the pressure chamber is filled with a liquid such as ink and due to the induced volume change, the pressure in the liquid changes resulting in a pressure wave in the liquid. The resulting pressure wave is designed to result in expelling a droplet of the liquid through the respective nozzle orifice.

In a particular piezo-electric actuated inkjet print head, the piezo-electric actuator is a bimorph actuator. Such a bimorph actuator is formed by layered structure comprising a membrane, a bottom electrode, a top electrode and a piezo-electric material layer, wherein the piezo-electric material arranged between the bottom and the top electrode. When a voltage is applied over the bottom electrode and the top electrode, the piezo-electric material deforms. In particular, the piezo-electric material layer thickens in a transverse direction and contracts in a lateral direction. The membrane however is not contracting and as a result the piezo-electric material near the bottom electrode and the membrane experiences more resistance to contraction than the piezo-electric material near the top electrode. As a result, the piezo-electric actuator bends.

In known bimorph piezo-eletric actuators, the actuator bends towards the membrane. As the membrane commonly forms the flexible wall of the pressure chamber, the volume of the pressure chamber becomes smaller when the bimorph actuator is actuated. On the other hand, for expelling a droplet, the volume is commonly first increased and then the volume is suddenly decreased. In order to enable such operation, a bias-voltage is applied over the bottom electrode and the top electrode when the print head is in a stand-by state. Then, when a droplet needs to be expelled, the bias voltage is lowered (thereby increasing the pressure chamber volume) and then an actuation voltage is applied for decreasing the pressure chamber volume. The actuation voltage may have a same voltage level as the bias voltage or it may have another voltage level. In the latter case, after expelling the droplet, the voltage over the bottom electrode and the top electrode is again brought to the level of the bias voltage or, if another droplet needs to be expelled, it may be lowered again.

A disadvantage of the known bimorph actuator is the need for the bias voltage. Applying a bias voltage results in a deformed actuator, including corresponding stresses in the different layers of the actuator. Ultimately, these stresses shorten the lifetime of the actuator. Further, the application of the bias voltage requires dedicated driver electronics, which dissipate energy and thus generate heat while providing for the bias voltage.

SUMMARY OF THE INVENTION

In a first aspect of the present invention, an inkjet print head according to claim 1 is provided. The inkjet print head comprises a pressure chamber for holding an amount of the liquid; a nozzle orifice in fluid communication with the pressure chamber, wherein the droplet of the liquid is to be ejected through the nozzle orifice; and an actuator assembly forming a deflectable wall of the pressure chamber for generating a pressure change in the amount of the liquid held in the pressure chamber. The actuator assembly comprises a flexible membrane and a piezo-electric actuator arranged on the flexible membrane such that the flexible membrane flexes when a drive voltage is applied over the piezo-electric actuator. The piezo-electric actuator is arranged on the membrane at a first side of the piezo-electric actuator and a passive layer is arranged on the piezo-electric actuator at a second side of the piezo-electric actuator, wherein the second side is opposite to the first side. The membrane is more compliant than the passive layer at least in a lateral direction.

Providing a passive layer over the top electrode side of the piezo-actuator causes the piezo-electric material near the top electrode to be restrained with respect to the contraction. Moreover, since the passive layer is less compliant in the lateral direction than the membrane, the piezo-electric material near the membrane contracts less than the piezo-electric material near the bottom electrode and near the membrane. Consequently, the piezo-electric actuator flexes in the transverse direction towards the passive layer and thus the volume of the pressure chamber is increased when a voltage is applied over the top and bottom electrodes. For the above-described modus of operation, a bias voltage is not needed and may be omitted. Omitting the bias voltage reduces the power consumption and increases the expected lifetime.

It is noted that in the prior art, as disclosed in e.g. US2010/0149284A1, it is known to provide for a protective layer for protecting a piezo-electric actuator against moisture or an insulating layer for preventing against short-circuiting. Further, it is known e.g. from EP0919383A2 to control stress in an actuator layer package having multiple layers forming the actuator to achieve a minimum initial deflection. Neither of these prior art teachings include a disclosure or teaching to change the mode of operation in accordance with the present invention. Moreover, both are directed at maintaining and improving the prior art mode of operation. Hence, the additional layers disclosed in the prior art are more compliant than the membrane.

In an embodiment, the passive layer is relatively thick and the membrane is relatively thin, in particular the membrane is thinner than the passive layer. Suitably selecting a thickness of membrane and passive layer allows to select a suitable compliance, at least in the lateral direction, for each of the layers and thus of the bending characteristics of the actuator assembly when the drive voltage is applied. In a particular embodiment of the inkjet print head, the membrane has a membrane thickness in the range of about 0.1 to about 1.0 micron and wherein the passive layer has a passive layer thickness in the range of about 1 to about 10 micron.

In an embodiment of the inkjet print head according to the present invention, the membrane is formed of siliconoxide ($SiO_x$) and the passive layer is formed of another material, in particular formed of siliconnitride (SiN). Other suitable materials for the passive layer include materials that are electrically isolating and are suitably applied by any suitable method of application. The passive layer may have an uniform passive layer thickness over the whole layer or has a predetermined passive layer thickness, wherein the layer thickness may vary over the whole layer. For example, the layer may be thicker on the actuator to control the bending characteristics of the actuator assembly.

In an embodiment of the inkjet print head according to the present invention, the membrane is arranged at the pressure chamber side of the actuator assembly. In this embodiment, the bias voltage is not needed to use the operation mode of first increasing the volume of the pressure chamber and then decreasing the volume of the pressure chamber for expelling a droplet through the nozzle orifice.

In another embodiment of the inkjet print head according to the present invention, however, the passive layer is arranged at the pressure chamber side of the actuator assembly. In this embodiment, the passive layer is used to shield the actuator from the liquid in the pressure chamber. As a result, a bias voltage will be needed to employ the operation mode of first increasing and then decreasing the volume of the pressure chamber. Still, in this embodiment, a more cost-effective print head design is enabled. An additional wafer layer may be omitted. Considering that each additional wafer increases the costs linearly and presuming that a prior art design requires three wafer layers, this embodiment may save up to one third of the manufacturing costs, which may be commercially feasible despite the need for a bias voltage and a corresponding, potentially shorter lifetime.

In a second aspect of the present invention, an inkjet printing assembly comprising an inkjet print head according to the first aspect, wherein the inkjet printing assembly is provided with heating means for heating at least the liquid to be expelled through the inkjet print head to an elevated temperature. Some liquids such as hotmelt inks and gelling inks require an elevated temperature when being expelled. Once applied on a recording substrate, such liquids cool and settle. The elevated temperature however negatively impacts the stability of the piezo-electric material, in particular when under stress due to an applied (bias) voltage. So, the piezo-electric efficiency degrades over time, consequently requiring an increased drive voltage for expelling droplets. Eventually, the drive voltage needs to be too large to be technically feasible and/or requiring too complex or expensive drive electronics resulting in an early end of lifetime of the print head. In this embodiment, wherein a liquid at elevated temperature is used, when employed in an operation mode without bias voltage, the efficiency stability is improved.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
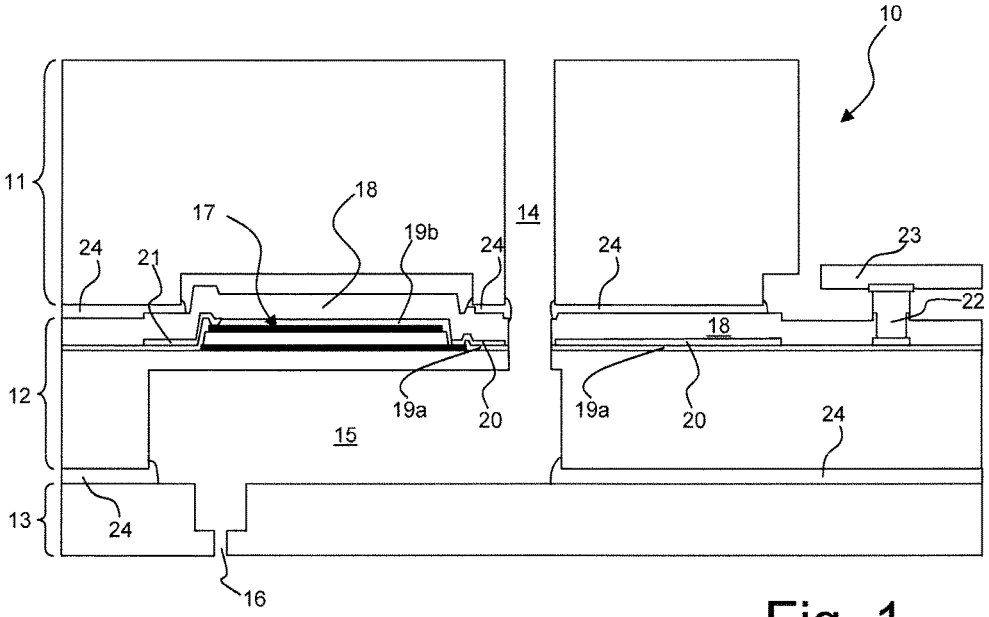
FIG. 1 illustrates a cross-section of a print head according to the present invention.

The present invention will now be described with reference to the accompanying drawings, wherein the same reference numerals have been used to identify the same or similar elements throughout the several views.

FIG. 1 schematically shows a cross-section of an inkjet print head 10 that may be manufactured using MEMS-processing. In particular, the inkjet print head 10 may be composed of three layers, i.e. a base layer 11, an actuator layer 12 and a nozzle layer 13, wherein each layer 11, 12, 13 may be manufactured from a silicon wafer and processed by suitable manufacturing techniques such as etching. The layers 11, 12, 13 may be attached to each other by use of a suitable adhesive layer 24 or any other suitable method. It is considered that such MEMS-processing is within the ambit of the skilled person and is not elucidated herein in more detail.

The inkjet print head 10 is provided with an inlet 14, a pressure chamber 15 and a nozzle orifice 16. The inlet 14 may be in fluid communication with a liquid reservoir (not shown). A liquid such as ink may be provided from the liquid reservoir through the inlet 14 to the pressure chamber 15. A droplet of the liquid may be expelled through the nozzle orifice 16, as is well known in the art. Hereinafter, the inkjet print head 10 and its operation are described with reference to an ink being used as the liquid. However, the scope of the present invention is not limited to the use of an ink; any other suitable liquid may be used in combination with the present invention as well.

At least one wall of the pressure chamber 15 is flexible and moveable by driving an actuator assembly 17, which is described in more detail hereinafter with reference to FIGS. 2A and 2B. In FIG. 1, a protective layer 19*a* and 19*b* is provided over the actuator layer 12, including over the actuator assembly 17. Further, in accordance with the present invention, a passive layer 18 is arranged over the actuator assembly 17. In order to operate the actuator assembly 17, a first led electrode 20 and a second lead electrode 21 are provided, each electrically connected to a bottom electrode and a top electrode, respectively. Through a suitable pattern of leads on the actuator layer 12, each lead electrode 20, 21 is electrically connected to a respective bond pad 22, which may be used to connect to an external wiring 23.

Figure 2A:
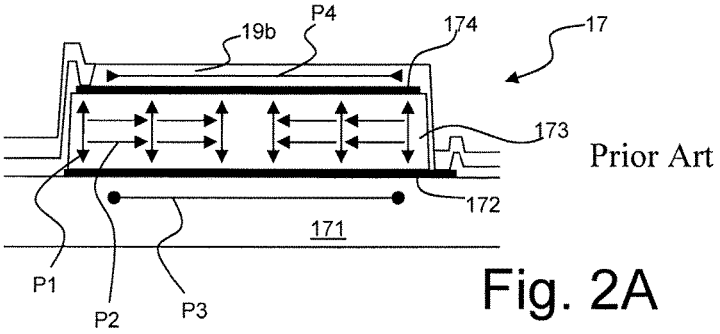
Prior Art Fig. 2A
FIG. 2A illustrates a cross-section of a prior art actuator assembly.

In FIG. 2A, an actuator assembly 17 according to the prior art is shown. The actuator assembly 17 comprises a membrane 171 and a piezo-electric actuator, wherein the piezo-electric actuator comprises a bottom electrode 172, a piezo-electric material layer 173 and a top electrode 174. The piezo-electric material layer 173 may be made of PZT-material, for example, or any other material exhibiting piezo-electric properties. The protective layer 19*b* is provided on top of the top electrode 174. The protective layer 19*b* may be provided to protect against moisture or any other external influences.

When a voltage is applied over the bottom electrode 172 and the top electrode 174, crystals in the piezo-electric material of the piezo-electric material layer 173 stretch and contract. As a result, the piezo-electric material layer 173 thickens in a transverse direction as indicated by the thickening arrow P1. Further, the piezo-electric material layer 173 contracts in a lateral direction as indicated by the contraction arrow P2. The membrane 171 and the protective layer 19*b* are however not activated and have no tendency to contract. Due to material properties and dimensions, the protective layer 19*b* and the membrane 171 have a certain compliance to follow the contraction of the piezo-electric material layer 173. In the prior art, the membrane 171 may have a thickness in the range of about 1 to about 10 microns, while the protective layer 19*b* is commonly kept as thin as possible and has in practice a thickness of up to about 1 micron. As a result, in the prior art, the membrane 171 is less compliant to contraction in lateral direction than the protective layer 19*b* as indicated by compliance arrow P3 having rounded ends and by compliance arrow P4 having arrowed ends. The difference in compliance to contraction between the membrane 171 and the protective layer 19*b* ultimately determines how the actuator assembly 17 behaves when a drive voltage is applied over the bottom and top electrodes 172, 174. In this prior art embodiment of FIG. 2A the actuator assembly 17 will bend and bulge towards the membrane 171 as is shown in and is described in relation to FIG. 3B, for example.

Figure 2B:
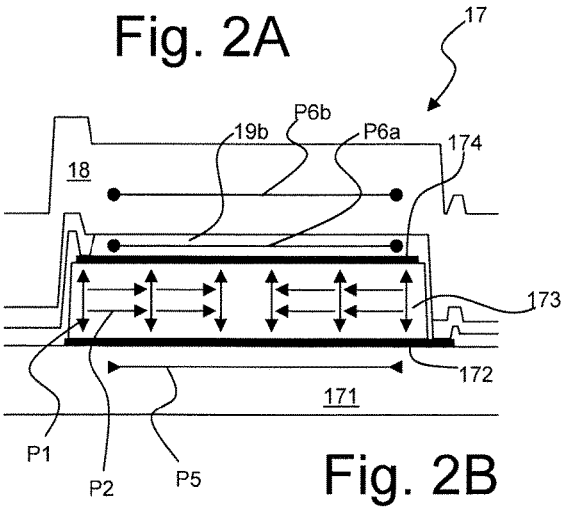
FIG. 2B illustrates a cross-section of an actuator assembly according to the present invention.

FIG. 2B shows an embodiment of the present invention, wherein an additional passive layer 18 is provided on top of the protective layer 19*b* as compared to the prior art embodiment of FIG. 2A. It is however noted that in practice the passive layer 18 and the protective layer 19*b* may be formed by a single layer.

The passive layer 18 is relatively thick. The passive layer 18 and the protective layer 19*b* together form layer package that is less compliant to lateral contraction than the membrane 171 as indicated by compliance arrows P6*a*, P6*b* (for the protective layer 19*b* and the passive layer 18, respectively) and the compliance arrow P5 (for the membrane 171).

Figure 4A:
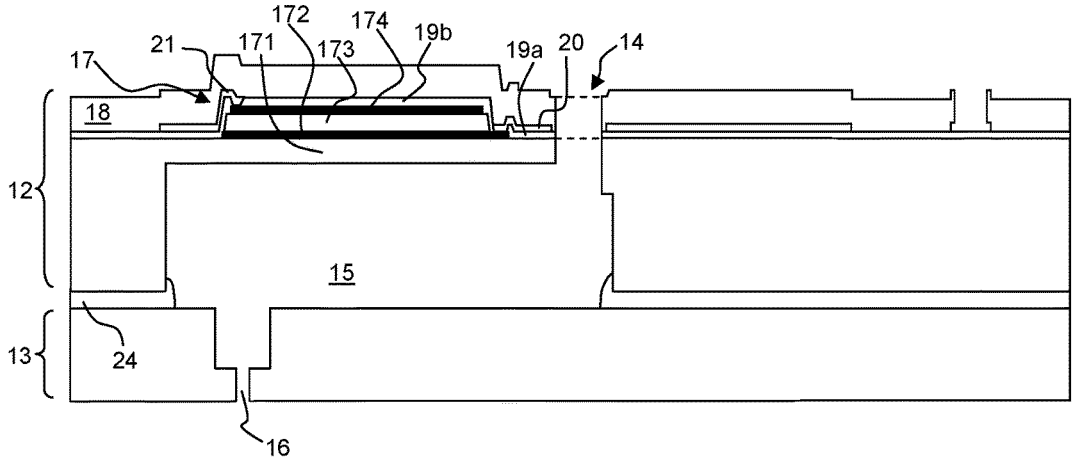
FIGS. 4A-4C illustrate a method of operation of the actuator assembly of the present invention according to FIG. 2B.
Figure 4B:
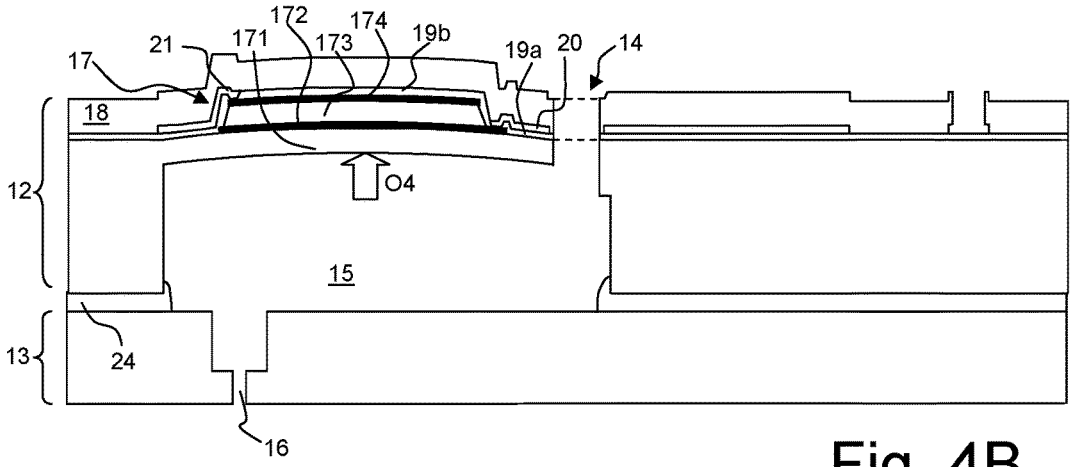

Since the membrane 171 is now the more compliant side of the actuator assembly 17, the actuator assembly 17 will, under influence of a drive voltage over the bottom and top electrodes 172, 174, bend and bulge towards the less compliant side, i.e. towards the protective layer 19*b* and the passive layer 18, which is shown in and is described in relation to FIG. 4B, for example.

The operation of an inkjet print head incorporating an actuator assembly according to FIG. 2A is now described in relation to FIGS. 3A-3D. FIGS. 3A-3D show a cross-section of the actuator layer 12 and the nozzle layer 13 as shown in FIG. 1 except that the passive layer 18 is omitted in correspondence to the actuator assembly 17 of FIG. 2A.

Figure 3A:
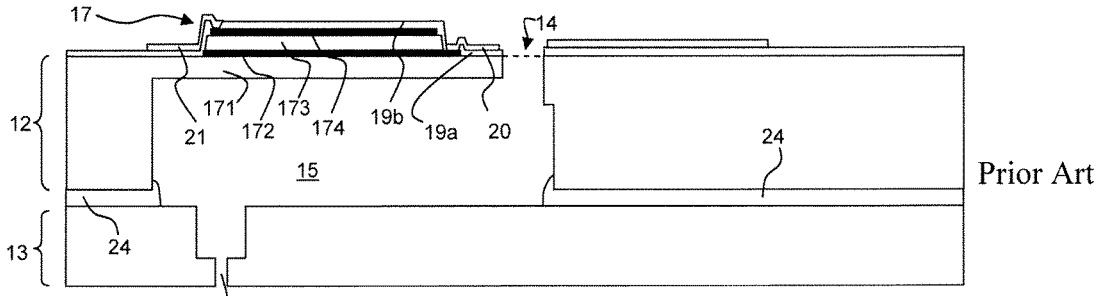
FIG. 3A-3D illustrate a method of operation of the prior art actuator assembly according to FIG. 2A.

In FIG. 3A, no drive voltage is applied over the top and bottom electrodes 174, 172. It is noted that in practice, due to tension in the layers of the actuator assembly generated during processing of the piezo-electric material layer 173, the actuator assembly 17 may be curved instead of flat. For the operation of the actuator assembly 17 and the print head 10 as a whole, this curvature is not relevant.

Figure 3B:
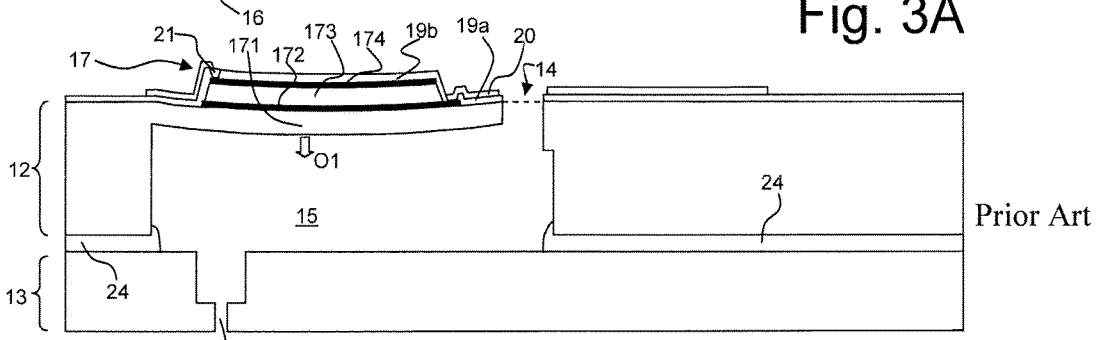
Figure 3C:
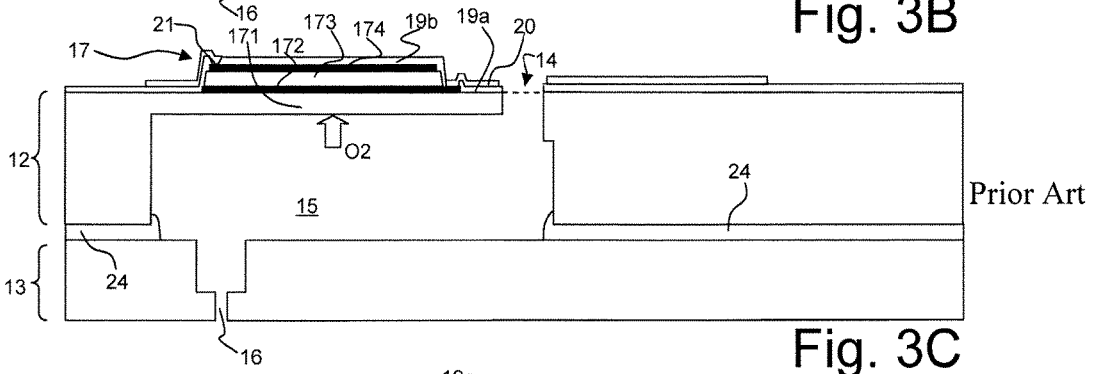

In FIG. 3B, a bias voltage is applied over the electrodes 172, 174. As a result, the actuator assembly 17 bends in the direction of operation arrow O1, i.e. towards the pressure chamber 15, thereby decreasing the volume of the pressure chamber 15. For stable operation, it is preferred to first fill the pressure chamber 15 with ink through the inlet 14 before expelling a droplet instead of first expelling a droplet through the nozzle 16 and then replenishing the ink in the pressure chamber 15. Hence, the bias voltage as applied in FIG. 3B, is applied slowly such that no ink is expelled through the nozzle 16, but only a pressure chamber volume is decreased. This state of the pressure chamber 15 may be maintained during printing operation and even during standby of a printer in which the print head 10 is mounted in order to be able to start printing quickly. In FIG. 3C, the actual droplet forming operation is started by removing the bias voltage as applied in FIG. 3B resulting in a movement of the actuator assembly 17 according to operation arrow O2. The actuator assembly 17 then returns to the state of FIG. 3A, thereby increasing the pressure chamber volume due to which ink is sucked in through the inlet 14.

Figure 3D:
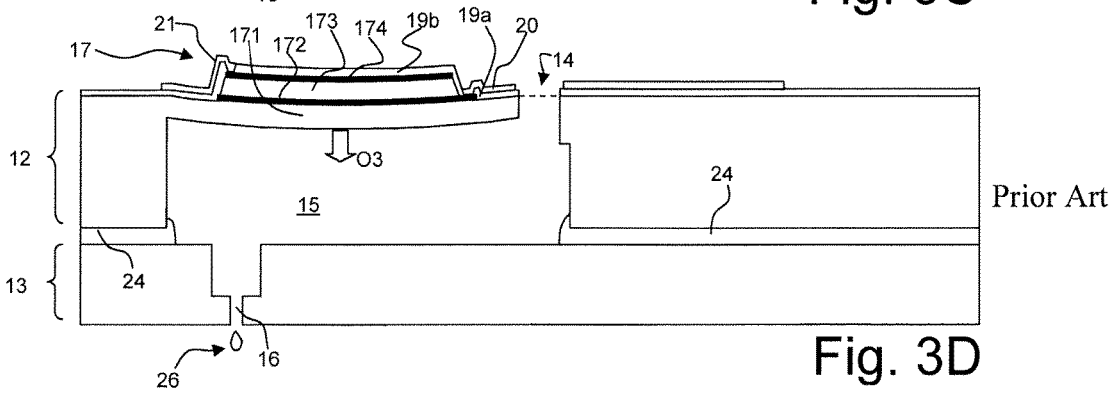

FIG. 3D illustrates a second step in the actual droplet forming operation, wherein a drive voltage is again applied over the electrodes 172, 174 resulting a movement of the actuator assembly 17 in the direction of operation arrow O3. This movement results in a decrease of the pressure chamber volume, thereby increasing a pressure in the ink in the pressure chamber 15 and ultimately resulting in such a pressure wave in the ink that a droplet 26 is expelled through the nozzle 16.

It is noted that the actuator assembly 17 has returned to the state of FIG. 3B and is thus again ready for a droplet formation operation again, provided that the drive voltage is maintained as the bias voltage. If drive voltage and bias voltage have a different voltage level, an additional step in the droplet formation operation may be needed to return the drive voltage to the bias voltage.

While the above method of operation is functional for generating droplets, the bias voltage is applied during a relatively long period when the print head is in a mere standby state. Consequently, the piezo-electric material properties degrade during standby and ultimately result in a relatively short lifetime of the actuator assembly 17 as discussed and elucidated hereinabove.

Figure 4C:
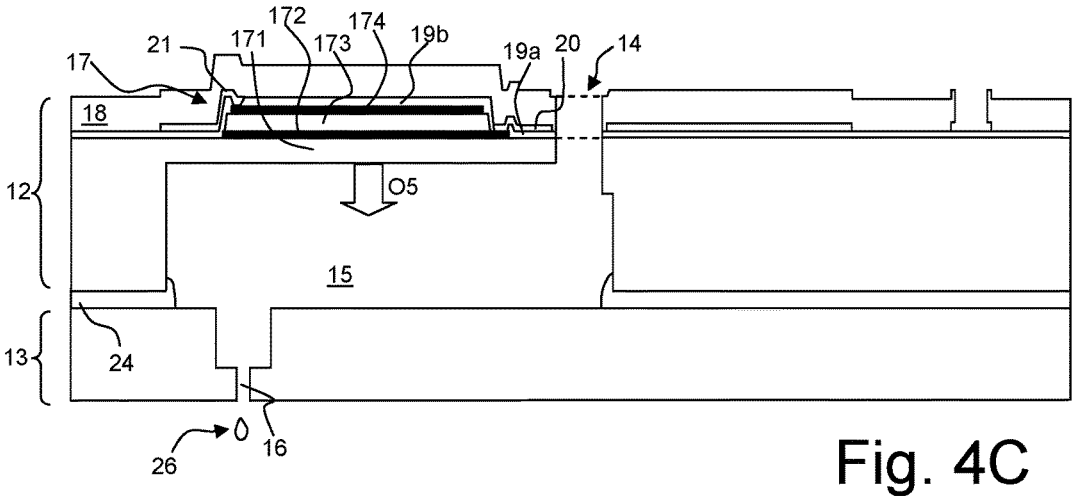

In FIG. 4A-4C, the actuator layer 12 is provided with the passive layer 18 in accordance with the present invention. FIG. 4A shows the actuator assembly 17 in rest, i.e. when no drive voltage or bias voltage is applied.

In FIG. 4B, a drive voltage is applied and in accordance with the present invention and as elucidated hereinabove with reference to FIG. 2B, the actuator assembly 17 bends away from the pressure chamber 15 as indicated by operation arrow O4, thereby increasing the pressure chamber volume and sucking ink into the pressure chamber 15. Removing the drive voltage results in a return to the original state (FIG. 4A), as indicated by operation arrow O5 in FIG. 4C, thereby generating a pressure wave in the ink resulting in expelling a droplet 26.

In the assembly of FIG. 4A-4C and the corresponding operation for expelling a droplet, there is no standby bias voltage. So degradation of piezo-electric properties is reduced to the short periods (in the order of only microseconds per droplet) during which a droplet forming operation is performed. Lifetime and droplet formation stability are thereby increased.

Figure 5A:
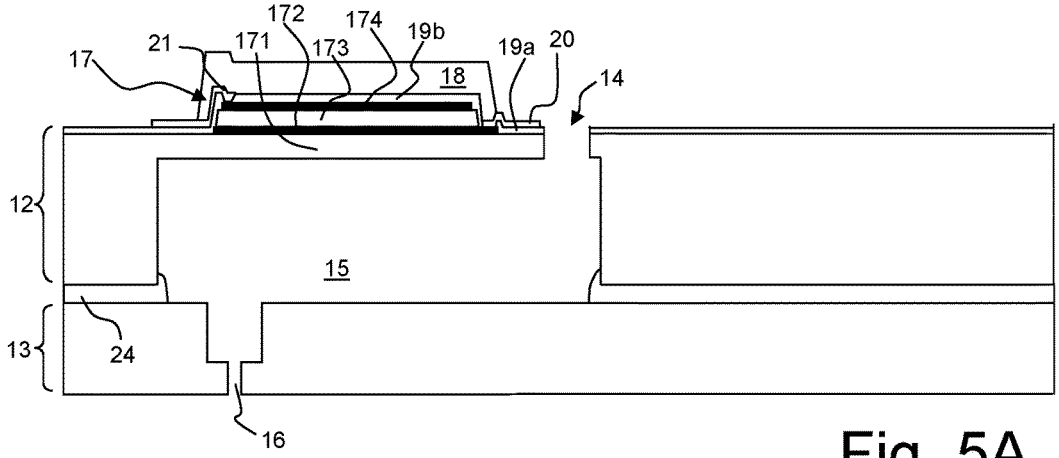
FIG. 5A-5B illustrate alternative embodiments of an actuator assembly according to the present invention.
Figure 5B:
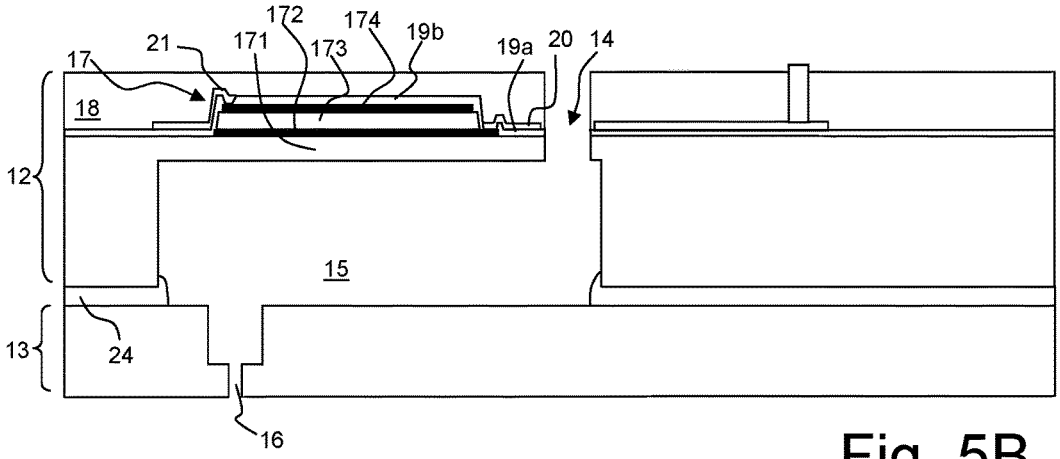

FIGS. 5A and 5B illustrate alternative embodiment of the print head according to the present invention. In particular, in FIG. 5A, the passive layer 18 has been provided only locally and not over the whole actuator layer 12. Thus the passive layer 18 only influences a compliance/resistance to contraction locally on the actuator assembly 17, while the remaining parts of the actuator layer 12 remain identical to the actuator layer of the prior art as shown in FIG. 3A. Thus, for example, bending properties of the membrane 171 near a wall of the pressure chamber 15 are not (or, in any case, less) affected by the passive layer 18.

While, in FIG. 4A, the passive layer 18 has a uniform thickness over the whole actuator layer 12, in FIG. 5B, the passive layer 18 has a locally varying thickness such that a flat top surface of the actuator layer results. Such a flat top surface may be advantageous for further processing steps for assembling the print head 10, for example.

Figure 6:
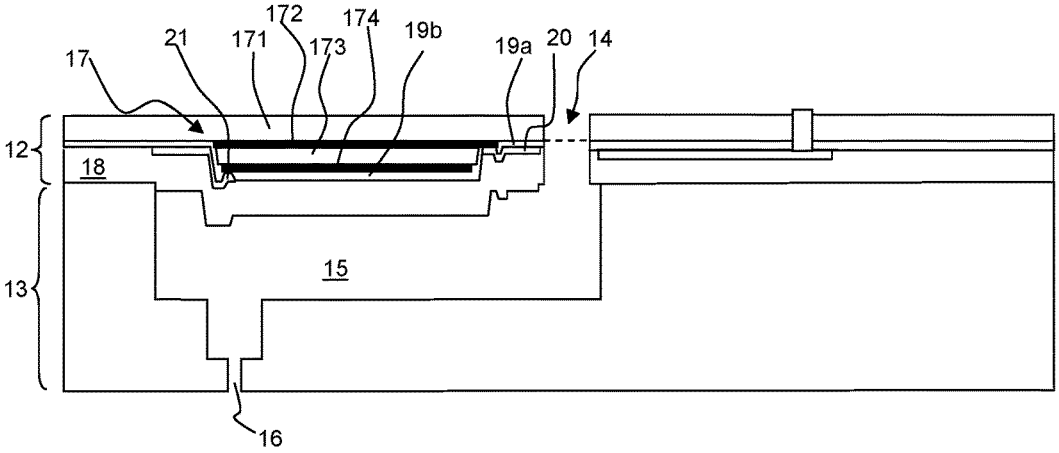
FIG. 6 illustrates a cross-section of an alternative embodiment of a print head incorporating an actuator assembly according to the present invention.

In FIG. 6, another embodiment of a print head 10 employing the passive layer 18 over the actuator assembly 17 in accordance with the present invention. In particular, the actuator layer 12 is flipped compared to the embodiments illustrated in FIGS. 4A-4C, 5A and 5B. The passive layer 18 now forms the flexible wall of the pressure chamber 15, while the membrane 171 is forming a top surface of the actuator layer 12. This is enabled as the thick passive layer 18 may be presumed to provide sufficient protection for the actuator assembly against the fluid in the pressure chamber 15. Further, the pressure chamber 15 is now provided in the nozzle layer 13. In this embodiment, it may be enabled to omit the base layer 11 (see FIG. 1), which would reduce the manufacturing costs of the print head significantly. In particular, as the costs are proportional to the number of print head layers, the costs may be reduced by up to 33% of the costs for the print head assembly of FIG. 1, since one of the three layers 11, 12, 13 is now omitted.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet print head for ejecting a droplet of a liquid, the inkjet print head comprising:

a pressure chamber for holding an amount of the liquid;

a nozzle orifice in fluid communication with the pressure chamber, wherein the droplet of the liquid is to be ejected through the nozzle orifice;

an actuator assembly forming a deflectable wall of the pressure chamber for generating a pressure change in the amount of the liquid held in the pressure chamber; wherein the actuator assembly comprises:

a flexible membrane;

a piezo-electric actuator arranged on the flexible membrane such that the flexible membrane flexes when a drive voltage is applied over the piezo-electric actuator;

a protective layer; and a passive layer;

wherein the piezo-electric actuator is arranged on the membrane at a first side thereof and the protective layer is arranged on the piezo-electric actuator at a second side thereof, the second side is opposite to the first side, wherein the membrane is more compliant than the passive layer at least in a lateral direction, wherein the actuator assembly is configured to bend away from the pressure chamber from application of a drive voltage to the piezo-electric actuator, and to return to an original state upon removal of the drive voltage to generate a pressure wave.

2. The inkjet print head according to claim 1, wherein the membrane is relatively thin and the passive layer is relatively thick and in particular the membrane is thinner than the passive layer.

3. The inkjet print head according to claim 2, wherein the membrane has a membrane thickness in the range of about 0,1 to about 1,0 micron and wherein the passive layer has a passive layer thickness in the range of about 1 to about 10 micron.

4. The inkjet print head according to claim 1, wherein the membrane is formed of siliconoxide ($SiO_x$) and wherein the passive layer is formed of another material, in particular formed of siliconnitride (SiN).

5. The inkjet print head according to claim 1, wherein the membrane is arranged at the pressure chamber side of the actuator assembly.

6. The inkjet print head according to claim 1, wherein the passive layer is arranged at the pressure chamber side of the actuator assembly.

7. An inkjet printing assembly comprising an inkjet print head according to claim 1, wherein the inkjet printing assembly is provided with heating means for heating at least the liquid to be expelled through the inkjet print head to an elevated temperature.

8. The inkjet print head according to claim 1, wherein the protective layer has a first side and a second side opposite the first side, and wherein the first side of the protective layer is arranged on the piezo-electric actuator, and wherein the passive layer is arranged on the second side of the protective layer.

9. The inkjet print head according to claim 1, wherein the passive layer encompasses the entirety of the piezo-electric actuator.

* * * * *